United States Patent [19]

Keller

[11] 4,115,842

[45] Sep. 19, 1978

[54] FLASHLIGHT AND FLASHLIGHT CHARGING RECEPTACLE

[75] Inventor: Donald A. Keller, Irvine, Calif.

[73] Assignee: International Telephone and Telegraph Corporation, New York, N.Y.

[21] Appl. No.: 709,764

[22] Filed: Jul. 29, 1976

[51] Int. Cl.[2] ..... F21L 7/00

[52] U.S. Cl. ..... 362/183

[58] Field of Search ..... 240/10.6 CH, 10.66, 240/10.6 R, 8.18, 47

[56] References Cited

U.S. PATENT DOCUMENTS

| | | | |
|---|---|---|---|
| 3,005,090 | 10/1961 | Moore | 240/10.6 CH |
| 3,339,065 | 8/1967 | Kelley | 240/47 X |
| 3,825,740 | 7/1974 | Friedman et al. | 240/10.6 CH |
| 3,829,676 | 8/1974 | Nelson et al. | 240/10.6 CH |

FOREIGN PATENT DOCUMENTS

| | | | |
|---|---|---|---|
| 2,241,744 | 3/1975 | France | 240/10.6 CH |

*Primary Examiner*—Richard L. Moses
*Attorney, Agent, or Firm*—Thomas L. Peterson

[57] ABSTRACT

A flashlight charging and storage receptacle has a battery charger in its base. The charger includes a male plug which cooperates with a female electrical receptacle in a charging circuit of a flashlight stored in the flashlight receptacle when the flashlight is not in use. The receptacle of the flashlight also serves to operate a separate electrical device, such as a warning light. The base of the flashlight receptacle has ventilation holes to keep a charging resistor and light emitting diode cool. The receptacle has feet for mounting on a vertical wall, such as a wall of a vehicle with the head of the flashlight angled away from the wall for easy access.

4 Claims, 5 Drawing Figures

FLASHLIGHT AND FLASHLIGHT CHARGING RECEPTACLE

BACKGROUND OF THE INVENTION

The present invention relates to flashlights, flashlight receptacles, and battery charging circuits for flashlights.

Flashlights, as well known, are typically powered by dry cells which lose their power in time requiring replacement of the cells. In recent years rechargeable cells have become available.

The power source in a flashlight, of course, is suitable for use in powering other electrical devices than flashlights. To date, however, there has been no convenient way of tapping these power sources without their removal from the flashlight.

Flashlights, as convenient as they are in use, are inconvenient when they are not in use. This is especially so in vehicles.

SUMMARY OF THE INVENTION

The present invention provides a flashlight storage receptacle and battery charger in combination with a flashlight, which itself has a portion of a charging circuit which can be used to power an auxiliary electrical device.

In a specific form, the storage charging receptacle is a cylindrical, barrel-like cylinder which receives the butt end of the flashlight and a portion of the flashlight battery housing. An axial plug mounts in the base of the receptacle and cooperates with a female plug receptacle in the butt end of the flashlight to complete a charging circuit for rechargeable batteries of the flashlight. The charging circuit may be from a vehicle's power source or it may be from an alternating current power source. The plug receptacle has positive and negative terminals which cooperate with like terminals of the plug to complete the circuits. In either event, the circuit preferably has a light emitting diode and a charging resistor in parallel circuit with one another in a circuit housing in a base of the receptacle. These elements are in series with the positive terminal of the plug. The plug mounts on the circuit housing on the axis of the barrel. A grill at an exposed end of the circuit housing allows cooling air to cool the charging resistor and light emitting diode. A bracket of the receptacle may have feet to mount the receptacle on a vertical surface, preferably with the head of the flashlight angled slightly outward from the vertical surface for presentation to a user. The mounting bracket preferably attached to the receptacle proper by a girth strap.

The plug receptacle of the flashlight directly couples in circuit an auxiliary electrical device, such as a warning light, to the flashlight batteries. The device purchases on the butt end of the flashlight through a casing which telescopically receives the butt end. A male plug of the device does the actual circuit coupling.

These and other features, aspects and advantages of the present invention will become more apparent from the following description, appended claims and drawings.

DESCRIPTION OF THE PREFERRED EMBODIMENTS

Figure 1:
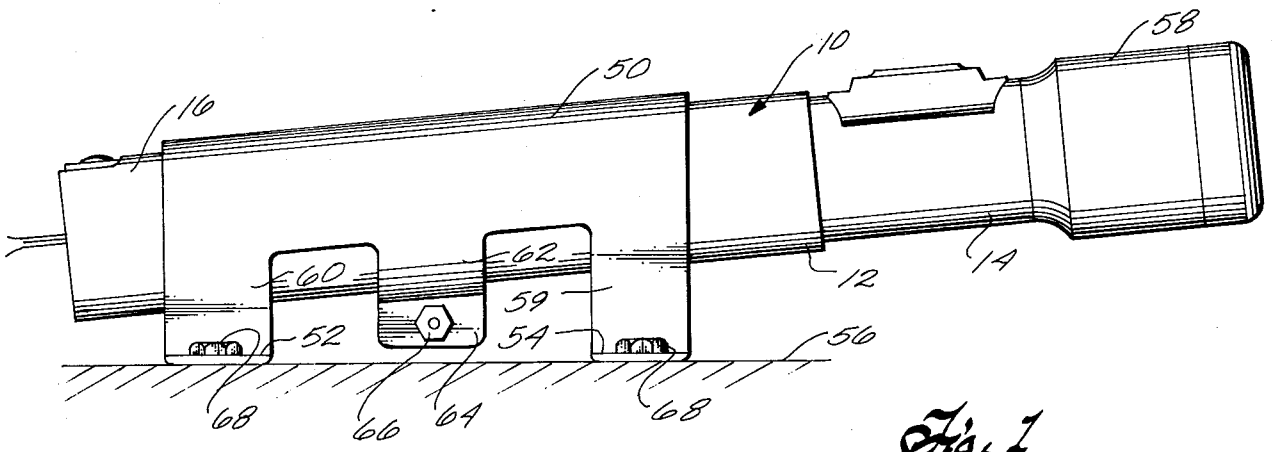
FIG. 1 is a side view of the charging and storage receptacle and flashlight of the present invention.
Figure 2:
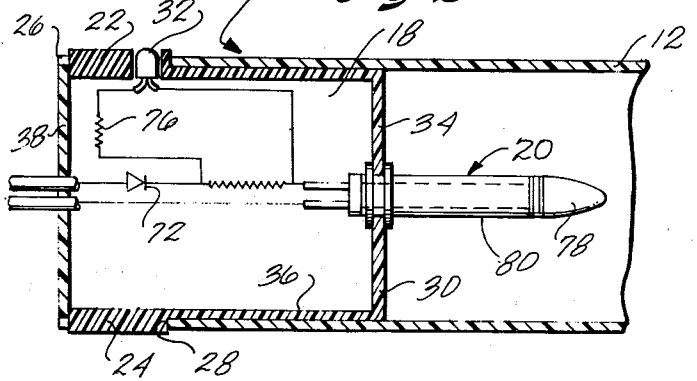
FIG. 2 illustrates in half section the base of the charging and storage receptacle of FIG. 1.

With reference to FIGS. 1 and 2, a flashlight charging and storage receptacle 10 is defined by a barrel 12, which is right cylindrical in form and has an inner diameter sized to receive the battery housing of a flashlight 14. A base 16 of the receptacle houses a charging circuit 18 (see FIG. 2). The base also mounts a male plug 20 axially of the barrel. This male plug cooperates with a female plug receptacle in the base of the flashlight to couple rechargeable cells in the flashlight in electric circuit with a source of charging current. The barrel 12 and base 16 of the receptacle and the housing of the flashlight are formed of a suitable insulation material, such as plastic, as shown.

Continuing with FIG. 2, base 16 has a pair of diametrically opposed and longitudinally extending ears 22 and 24 received in complementary recesses 26 and 28 in barrel 12. This cooperation axially and rotationally locates a charging circuit housing 30 of the base in the posterior end of the barrel with a light emitting diode 32 facing outwardly to indicate that the charging circuit is in use.

Charging circuit housing 30 is in the form of a cup with an end wall 34 extending radially of the axis of the barrel. A cylindrical portion 36 of the cup extends longitudinally of the barrel and is received in the barrel. The housing secures in the base in any convenient fashion, but typically when the housing and the barrel are plastic by glue. A grill plate 38 caps the open end of housing 30. This plate has a plurality of cooling holes in it to permit air to circulate in the housing and cool its contents.

Figure 3:
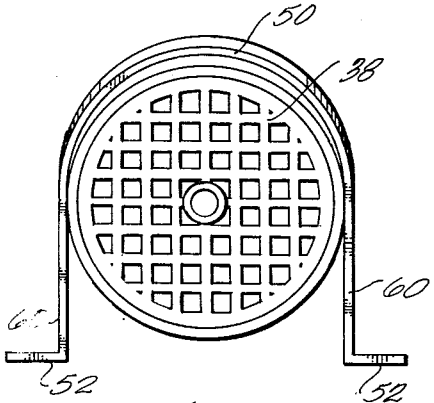
FIG. 3 is an end view of the charging and storage receptacle of the previous Figures illustrating the cooling grill at the base thereof and a mounting bracket.

With reference to FIGS. 1 and 3, a mounting bracket 50 receives barrel 12 of the charging and storage receptacle and provides depending feet 52 and 54 which stand the barrel off a vertical surface 56 at an angle so that a head 58 of the flashlight is more readily grasped by a user. Feet 54 have legs 59 longer than legs 60 for feet 52 to effect this angular disposition. The mounting bracket includes a girth strap 62 with a pair of terminal pads 64 clamped together by a fastener 66 to attach the bracket to the barrel of the charging and storage receptacle. The feet may have holes to accept mounting fasteners 68 which attach in the wall behind surface 56. As is apparent from FIG. 3, the bracket is symmetrical about a bisecting plane through the axis of the barrel. As an alternative to the bracket shown, the feet and legs can be made of plastic and attached to a plastic barrel 12, as by ultrasonic or solvent welding.

The flashlight itself is standard, with the exception of a portion of the charging circuit. This charging circuit, as previously detailed, includes a female receptacle, shown in FIG. 4 at 70. The charging circuit places rechargeable batteries of the flashlight into electrical circuit with a charging source while the flashlight is in the storage and charging receptacle because plug 20 is in female receptacle 70 at that time.

The charging circuit for a vehicle is shown in FIG. 2 at 18 and includes a source of power, for example, the vehicle's power system, which is direct current. The power source is tapped in the ignition circuit so as to avoid drain when the vehicle is not running. A blocking diode 72 is in series circuit with a charging resistor 74. In parallel with the charging resistor is a branch circuit of a light emitting diode resistor 76 and light emitting diode 32. A center pin 78 of plug 20 is a positive terminal and is in series circuit with charging resistor 74 and the branch of resistor 76 and light emitting diode 32. The ground circuit includes an outer ring 80 of the plug. Internally of the flashlight, rechargeable batteries 82 (FIGS. 4 and 5) are in series circuit with center pin 78 of plug 20 through a positive terminal of a spring contact 83 of female receptacle 70. The grounding circuit goes to outer ring 80 of the plug and a ring contact 85 of the plug receptacle.

Figure 5:
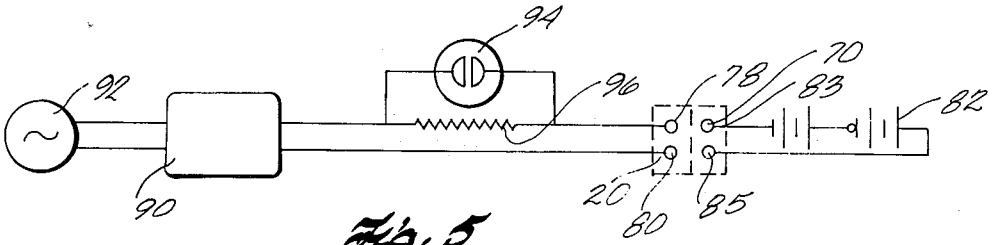
FIG. 5 illustrates a charging circuit of invention.

FIG. 5 illustrates the charging circuit for an alternating current source. The circuit in the flashlight remains the same as for charging from a vehicle's power source. An AC-DC converter 90 from a source of alternating current 92 is in circuit with the parallel circuit of a light emitting diode 94 and a charging resistor 96, which in turn are in circuit with the center pin 78 of plug 20. Outer ring 80 of the plug goes to the ground of the converter. The plug couples in electric circuit with the plug receptacle in the manner previously described.

Figure 4:
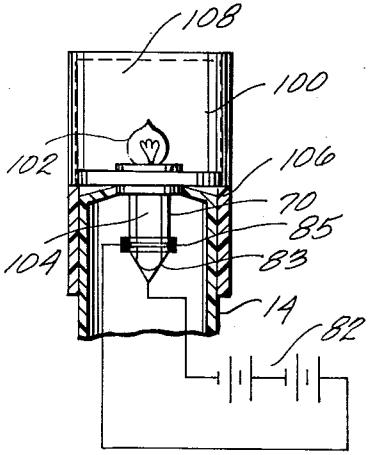
FIG. 4 illustrates the flashlight of FIG. 1 used with an auxiliary electrical device.

An auxiliary electrical device 100 is illustrated in FIG. 4 and merely plugs into the female receptacle 70 in the base of the flashlight whereby it is in circuit. It may itself have an operating switch or not for its energization. The device includes a light bulb 102 in electrical circuit with a plug 104 of identical configuration to plug 20. The plug is received in receptacle 70 to couple light bulb 102 electrically to batteries 82.

Device 100 includes a casing 106 in the form of a skirt which telescopically receives the posterior or butt end of the flashlight and purchases there. The casing mounts light bulb 102 and plug 104. A transparent cover 108 protects bulb 102 and can be colored, say red, to indicate warning. The circuit to bulb 102 can include a bimetal switch to cause the bulb to flash on and off.

Thus, the present invention provides a charging circuit for a flashlight conveniently housed in a base of a charging and storage receptacle for the flashlight. The receptacle keeps the flashlight at the ready. The flashlight, when it is not in use, may be charged and this charging may essentially be automatic, especially when the flashlight and receptacle are used in a vehicle. The cells of the flashlight are thus always at full power and the flashlight always fully charged. The flashlight also provides means for providing the power source for some other electrical device, such as a warning light. This is very conveniently done by merely turning the flashlight upside down and placing its head on a flat surface. The warning light is then mounted on the base above the flat surface to good effect.

The present invention has been described with reference to a certain preferred embodiment. The spirit and scope of the appended claims should not, however, necessarily be limited to the foregoing description.

What is claimed is:

1. A flashlight, battery charger, and auxillary power source comprising:

(a) a flashlight having a head with a flashlight bulb, an insulative battery housing, rechargeable batteries in the battery housing and in electric circuit with the flashlight bulb, and a female electrical receptacle within said housing at a butt end of the flashlight, the female receptacle having positive and negative terminals, the circuit to the female receptacle providing the batteries with charging current during a charging mode and drawing current from the batteries during an auxillary use mode, the auxillary use mode having the female receptacle in receipt of a male plug of an auxillary electrical device;

(b) a flashlight storage receptacle and battery charger for receipt of the flashlight, the storage receptacle and battery charger having insulative barrel means for receipt of the butt end and battery housing of the flashlight, a male plug within the barrel positioned to receive the female receptacle, positive and negative terminals of the plug for connection to the like terminals of the receptacle, charging circuit means to the male plug and adapted to be connected to a source of current to thereby charge the batteries of the flashlight;

said storage receptacle and battery charger including a circuit housing at the base thereof, the circuit housing mounting the male plug coaxially with the axis of the barrel and containing the circuit means;

said circuit means including a charging resistor and light emitting diode means in parallel circuit with the charging resistor, the parallel circuit being in series circuit with the positive terminal of the plug; and said circuit housing including a pair of diametrically opposed ears and the barrel includes a pair of diametrically opposed slots, the ears being received in the slots and the light emitting diode being mounted in one of the ears to face outwardly of the receptacle.

2. The flashlight, battery charger, and auxiliary power source claimed in claim 1 including a grill plate at the end of the circuit housing for circulation of cooling air to cool the circuit means in the housing.

3. The flashlight, battery charger, and auxiliary power source claimed in claim 2 including bracket means to mount the flashlight storage receptacle and battery charger, the bracket means has means on a surface with a head end of the flashlight raised comparatively further from the surface than the butt end of the flashlight.

4. A flashlight battery charger, and auxillary power source comprising:

a flashlight having a head end and a butt end, a flashlight bulb in the head end, a battery housing between the head end and the butt end, at least said butt end being of insulation material, rechargeable batteries in the battery housing and a charging circuit in the butt end, the bulb batteries and charging circuit being in electric circuit with each other, the charging circuit including a female electrical receptacle within said butt end in series circuit with the batteries and having an axis coaxial with the axis of the flashlight;

a storage receptacle and battery charger including a barrel, a charging circuit housing in the barrel, a charging circuit in the housing, a male plug coaxial with the barrel and positioned within an insulative base end thereof for receipt by the female receptacle of the flashlight and being in electrical circuit with the charging circuit of the storage receptacle and battery charger;

an auxillary electrical device having a male plug for receipt in the female receptacle at the base of the flashlight and having an electrical device in electrical circuit with terminals of the plug;

said auxillary device having a casing for receiving the butt end of the flashlight and for mounting the device on the flashlight in telescopic fashion;

a bracket having means to mount the storage receptacle and battery charger on a wall, said bracket including a girth strap tightly gripping the barrel to thereby attach the bracket to the barrel; and said bracket mounting means including depending feet longitudinally spaced apart, the feet at the end of the bracket proximate the head end of the flashlight disposed further from the axis of the barrel than the feet at the distal end to thereby raise the head end of the flashlight from a wall in which the bracket is mounted to facilitate grasping the flashlight by the user.

* * * * *